United States Patent [19]

Rica et al.

[11] Patent Number: 4,494,363

[45] Date of Patent: Jan. 22, 1985

[54] METHOD AND APPARATUS FOR ASEPTICALLY FILLING CONTAINERS

[75] Inventors: Albert F. Rica, Stockton, Calif.; John C. Davis, Palentine; Ronald J. Reiss, Hoffman Estates, both of Ill.

[73] Assignees: FranRica Mfg. Inc., Stockton, Calif.; Container Technologies, Inc., Barrington, Ill.

[21] Appl. No.: 409,927

[22] Filed: Aug. 20, 1982

[51] Int. Cl.[3] ..... B65B 7/02; B65B 31/02; B65B 55/04

[52] U.S. Cl. ..... 53/426; 53/88; 53/97; 53/109; 53/268; 53/434; 53/468; 53/469; 53/471; 53/478; 53/512; 53/381 A

[58] Field of Search ..... 53/468, 469, 471, 478, 53/492, 432, 88, 109, 268, 273, 329, 381 A, 510, 434, 512, 94, 97; 141/10, 19, 114, 154, 313, 314, 315, 329, 350

[56] References Cited

U.S. PATENT DOCUMENTS

| | | | |
|---|---|---|---|
| 2,106,192 | 1/1938 | Saville | 141/329 X |
| 2,761,603 | 9/1956 | Fairchild | 53/510 |
| 2,787,875 | 4/1957 | Johnson | 53/468 X |
| 2,870,024 | 1/1959 | Martin | 99/182 |
| 2,930,170 | 3/1960 | Holsman | 53/468 |
| 3,255,568 | 6/1966 | Martin | 53/510 X |
| 3,299,603 | 1/1967 | Shaw | 53/426 |
| 3,332,788 | 7/1967 | Barnby | 53/432 X |
| 3,356,510 | 12/1967 | Barnby | 99/182 |
| 3,385,022 | 5/1968 | Anderson | 53/88 X |
| 3,447,281 | 6/1969 | Bufor | 53/268 |
| 3,463,338 | 12/1969 | Brown | 53/381 A |
| 3,514,919 | 6/1970 | Ashton | 53/469 |
| 3,516,220 | 6/1970 | Buford | 53/502 |
| 3,630,242 | 12/1971 | Schleser | 141/114 |
| 3,765,142 | 10/1973 | Lindquist | 53/88 X |
| 3,899,862 | 8/1975 | Muys | 53/426 |
| 3,908,334 | 9/1975 | Rychiger | 53/510 X |
| 3,942,299 | 3/1976 | Bory | 53/48 |
| 4,120,134 | 10/1978 | Scholle | 53/281 X |

FOREIGN PATENT DOCUMENTS

| | | | |
|---|---|---|---|
| 2826477 | 1/1979 | Fed. Rep. of Germany | 53/88 |
| 2050319 | 1/1981 | United Kingdom | 53/510 |

*Primary Examiner*—John Sipos

*Attorney, Agent, or Firm*—Wood, Herron & Evans

[57] ABSTRACT

There is disclosed apparatus for aseptically filling a flexible container having a rigid fitment including a neck, outer flange surrounding the neck, a frangible membrane and an outer rim. The apparatus includes an enclosed filling chamber including a platen with an opening, clamping jaws for holding the fitment in the opening, a vacuum head and sealing unit for removing a lid loosely placed on the fitment and supporting it within the sealing chamber while the sealing chamber, fitment and lid are sterilized, a fill tube which is retractable within a housing and shiftable to a position in sealed engagement with the neck to introduce product into the container. After the container is filled, the fill tube is withdrawn and enclosed in its housing, the lid is transferred back onto the rim and heat sealed in place. The fitment is then unclamped to end the filling cycle.

36 Claims, 19 Drawing Figures

METHOD AND APPARATUS FOR ASEPTICALLY FILLING CONTAINERS

BACKGROUND OF THE INVENTION

The present invention relates to packaging and is more particularly directed to a method and apparatus for aseptically filling flexible containers.

In recent years there has been an increased use of flexible containers as an alternative to large metal cans for packaging food products, such as juices, sauces, purees, fruits and vegetables, for institutional and commercial use. These flexible containers are often formed from walls intended to provide substantial oxygen permeation resistance. It has also been proposed to provide such containers with fitments through which food product can be introduced into the container and which can subsequently be closed to protect the container's contents. Prior art packages and filling apparatus of this type are shown in Ashton et al U.S. Pat. No. 3,514,919 and Holsman et al U.S. Pat. No. 2,930,170.

In handling food products, it is extremely important that the flexible container be in a sealed, sterile condition before it is filled, that the filling take place under completely sterile conditions, and that the container remain sterile from the time it has been filled up to the time its contents are removed. It is also desirable that filling equipment be operated continuously for long periods without need to shut it down for resterilization. The present day commercial aseptic filling systems do not adequately meet these desiderata.

OBJECTS OF THE INVENTION

Accordingly, it is an object of the present invention to provide apparatus including a filling chamber for aseptically filling a flexible bag or other container which has been presterilized and which includes a fitment including a rigid neck and a frangible membrane which extends across the neck and seals the interior of the container. The present apparatus includes means for puncturing the membrane only after it has been inserted and locked into an opening in the filling chamber and sterilized. This insures that the container closure has not been tampered with, as is possible, for example, if a removable cap is used, and insures that the interior of the container remains sterilized until that point in the filling operation when the membrane is ruptured.

It is a further object of the present invention to provide a filling apparatus and method in which after filling the fitment is retained in sealed communication with an opening in the sterilized filling chamber and is sealed by a sterilized lid which is heat sealed to a rim on the fitment.

It is a further object of the present invention to provide an apparatus and method for aseptically filling a container in which the container fitment loosely carries a lid when it is locked into an opening in the filling chamber. The lid is removed by a lid handling mechanism within the filling chamber, shifted to a remote position within the chamber and subsequently returned to contact with the fitment.

It is a further object of the present invention to provide a filling machine in which at the commencement of the filling operation the filling chamber, the exposed portion of the fitment, including the frangible diaphragm, the lid and a lid handling and sealing means are sterilized by means of a sterilizing medium, such as steam.

It is a further object of the present invention to provide a filling apparatus in which a fill tube is utilized to introduce product into the container through the fitment, the fill tube forming a fluid-tight seal with the fitment. This seal is effected below and inside the top rim of the fitment. This prevents any product from being brought into contact with the sealing rim and thereby insures the formation of a completely effective seal when the lid is subsequently heat sealed to the rim. The complete efficacy of the seal together with the high oxygen permeation resistance of the flexible bag results in long shelf life for the product in the flexible bags filled by the present apparatus comparable to the shelf life of a number 10 can.

It is a further object of the present invention to provide a fill tube assembly in which the fill tube is retractable within a housing which communicates with the filling chamber and is sealed from that chamber at all times that the chamber is opened and in an unsterilized condition. Thus, the filling tube does not become contaminated and the apparatus can be run for several days without the necessity of shutting it down for sterilization.

Another object of the present invention is to provide a filling apparatus in which large bags, such as 300 gallon bags, can be filled while they are placed within box-like shipping containers. Such bags and boxes are relatively large and it is difficult for an operator to reach across such a box to lock the bag fitment into the filling chamber opening.

Accordingly, it is a further object of the present invention to provide a pivotal clamping jaw which can be positioned close to the perimeter of the container while the fitment is loaded into the jaw and subsequently can be pivoted into registry with the filling chamber opening so that the fitment is mechanically carried into filling position and seated.

SUMMARY OF THE INVENTION

In order to achieve the various objects of the present invention, the invention contemplates apparatus for filling a flexible bag or other container of the type having a fitment including a rigid neck, a frangible membrane sealing said neck, a rim for receiving a lid and an outwardly extending flange spaced from said rim. A preferred embodiment of the present filling apparatus comprises an enclosed filling chamber with an upper wall and a platen forming the lower wall. The platen is provided with an opening for receiving a bag fitment. Clamping means is provided adjacent the opening for surrounding the fitment neck and forcing the fitment flange against the platen so that the fitment effectively seals off the opening in the platen.

In accordance with the present invention, the filling chamber encloses a vacuum lid handling means and heat sealing unit effective initially to remove a thin foil lid which is temporarily placed on the rim of a fitment. The lid is transferred to a position within the filling chamber remote from the fitment and is ultimately replaced on the fitment after the bag is filled. The lid is then heat sealed to the rim.

The filling chamber further comprises a steam inlet through which steam can be introduced to sterilize the exposed portions of the fitment including its flexible membrane, the lid and the lid handling mechanism. In accordance with the present invention, the filling chamber carries a filling means, including a fill tube and housing, surrounding said fill tube. The housing is mounted on the upper wall of the filling chamber above an opening therein. The fill tube is adapted to be retracted within its housing and means are provided for sealing the housing to form an aseptic storage environment for the fill tube. Means are further provided to rinse the fill tube with a steam condensate while it is retracted within its housing.

After a fitment has been locked in place and the filling chamber sterilized, the fill tube is projected downwardly into engagement with the interior of the fitment neck. This accomplishes two things. First, the fill tube carries a member which ruptures the membrane to provide access to the interior of the bag and, secondly, the fill tube includes a tapered portion which seats against a bevelled shoulder on the inside of the neck to keep any food product from contacting the rim during the filling operation. The fill tube further includes a valve member which is opened after the fill tube has seated upon the fitment to allow food product to flow from the fill tube into the bag interior.

In a preferred form of filling apparatus, the bag bottom wall initially is positioned close to the upper wall and platen and is progressively lowered as the bag is filled. After the bag is filled, the fill tube is retracted into its housing which is then closed and sealed. After the housing is closed, the fill tube is washed with sterile condensate. Thereafter, the lid, which has remained in the sterilized filling chamber, is transported back into contact with the rim and is heat sealed to the rim. Finally, the clamping jaws, which have been holding the fitment in position, are released and the bag is removed from the unit.

One of the advantages of this apparatus is that it insures that the presterilized bag remains sterilized until it is filled with food product. Specifically, prior to filling, the bag is positively sealed by its membrane which is integral with the fitment and this membrane and all exposed portions of the fitment are sterilized prior to the time the diaphragm is ruptured and the bag is filled.

Another advantage of the present invention is that the filling apparatus itself is automatically maintained in an aseptic condition. Specifically, the enclosed filling chamber is sterilized after a bag fitment has been locked in place at the commencement of each filling cycle. Moreover, the fill tube is never exposed to an unsterile environment. It is normally stored within its own sealed housing and is projected into the filling chamber only after that chamber has been sterilized at the commencement of a cycle. After the bag is filled, the fill tube is withdrawn to its sealed chamber prior to the time that the bag fitment is removed from the filling chamber opening. After the sealed chamber holding the fill tube is closed, the fill tube is washed with sterile condensate. Consequently, the present filling apparatus can be operated over long periods of time without the necessity of stopping operation for any fill tube cleaning or resterilization procedure.

Another advantage of the present filling apparatus is that it insures that the lid is completely and effectively sealed to the rim of the fitment since the rim has been kept free of any food particles which would lead to a defective seal by virtue of the sealing engagement of the fill tube and neck during the filling operation.

BRIEF DESCRIPTION OF DRAWINGS

These and other objects and advantages of the present invention will be more readily apparent from a consideration of the following detailed description of the drawings illustrating a preferred embodiment of the invention.

In the drawings.

DESCRIPTION OF A PREFERRED EMBODIMENT

Figure 13:
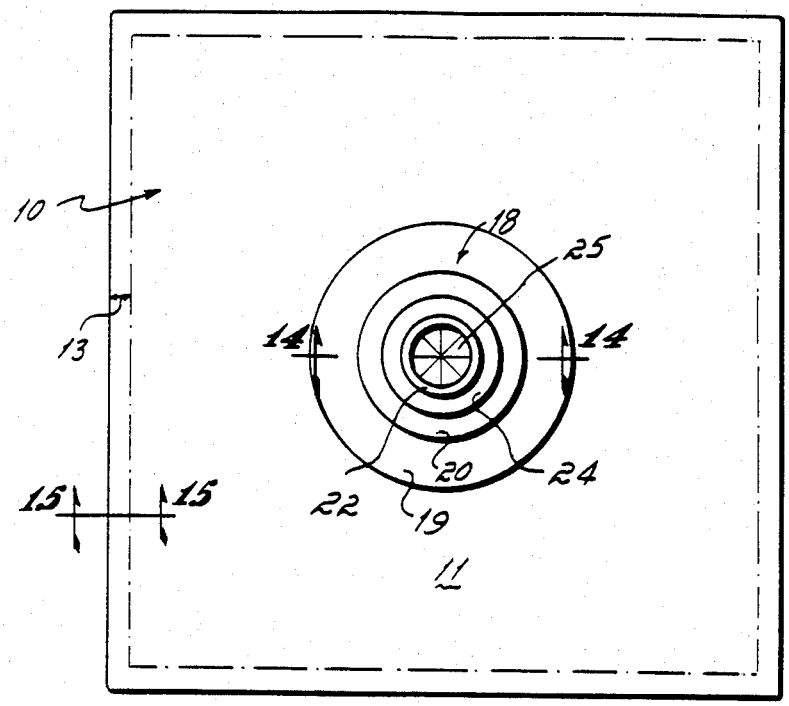
FIG. 13 is a plan view of one preferred form of flexible container for use with the present bag filling machine.
Figure 14:
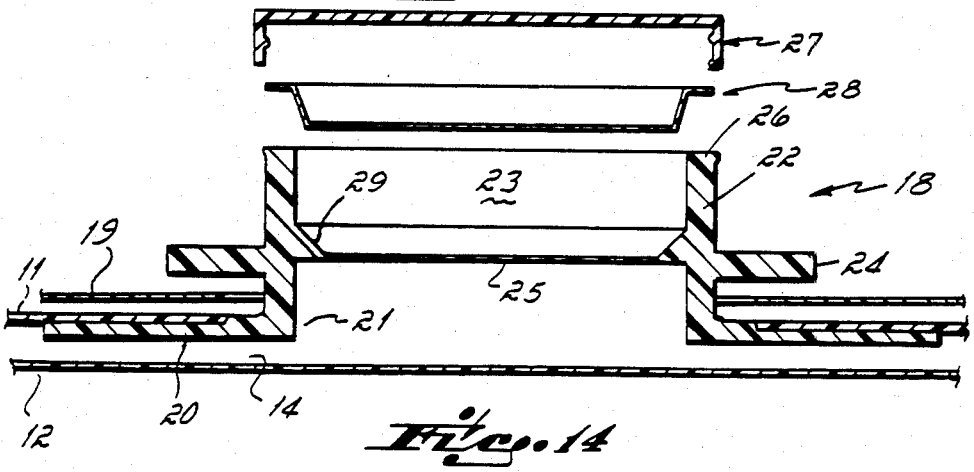
FIG. 14 is a cross-sectional view along line 14—14 of FIG. 13.
Figure 15:
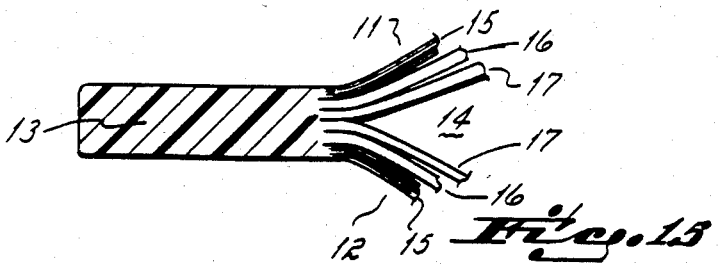
FIG. 15 is an enlarged semi-diagrammatic cross-sectional view along line 15—15 of FIG. 13.

One suitable form of container 10 for use in conjunction with the present filling apparatus is illustrated in FIGS. 13, 14 and 15. As there shown, the container 10 is a flexible bag of generally rectangular configuration. The container comprises upper and lower multi-ply walls 11 and 12 which are sealed about the periphery of the container by heat seals 13. The space 14 between upper wall 11 and lower wall 12 is adapted to contain sterilized food product, such as, for example, vegetables, fruit concentrates, purees, sauces and juices.

In one preferred embodiment, the composite upper and lower walls are identical with each comprising three separate plies. The outer ply 15 of each wall is a multilayer barrier film in which the outer layer is formed of nylon film 0.007" thick. One suitable grade of nylon is known as "Nylon 6". The next innermost layer is formed of ethyl vinyl alcohol and is 0.003" in thickness. The third layer is a 0.002" thick layer of nylon similar to the outer layer. The next innermost layer is a tie layer 0.002" in thickness. This tie layer is preferably a copolymer of linear low density polyethylene (L.L.D.P.E.) known as "Plexar-II" made by Chemplex Company of Rolling Meadows, Ill., which material is more fully described in U.S. Pat. No. 4,254,169 at column 3. The next layer of film is formed of linear low density polyethylene 0.007" in thickness. The next layer is another tie layer similar to that previously described 0.0002" in thickness. The innermost layer of the outer ply 15 is a layer of linear low density polyethylene 0.002" in thickness.

The center ply 16 and the inner ply 17 of walls 11 and 12 are formed of linear low density polyethylene 0.003" in thickness. The walls of bag 10 provide high strength to withstand shipment and handling and high oxygen permeation resistance to provide a long shelf life.

In one preferred embodiment, flexible bag 10 is sized to hold 300 gallons of material. It is to be expressly understood, however, that bags of other capacities such as, for example, five or 50 gallons, and bags formed of other wall materials, can be utilized with the present filling equipment.

As shown in FIGS. 13 and 14, bag 10 is provided with a fitment 18 through which the product is introduced into the bag. Fitment 18 is preferably molded of a suitable material, such as high density polyethylene. One suitable material is ARCO PETROCHEMICAL RESIN No. 7050. The fitment includes a lower, outwardly extending flange 20 which is adapted to be heat sealed to the inside of the inner layer 17 of one wall of the bag. This flange surrounds a circular opening 21 cut into the bag wall.

Fitment 18 further includes an upstanding rigid neck 22 forming a fill opening 23 of the order of 2" in diameter. In the preferred embodiment, the neck is approximately 1" in height. Neck 22 carries an intermediate clamping flange 24 which is spaced from the lower flange 20 a sufficient distance, for example, 0.250", to accommodate clamping jaws of the filling machine as explained below. In a preferred embodiment of container, the outer diameter of clamping flange 24 is less than the diameter of the lower flange, e.g., the diameter of the lower flange is 4.5", while the diameter of the intermediate flange 24 is 3.25".

Fitment 18 further comprises a transverse frangible membrane, or diaphragm, 25 which extends across the fill opening 23 and seals the interior of the bag. Membrane 25 is sufficiently strong to withstand a pressure of from 15–30 psi to which the membrane is exposed during steam sterilization immediately prior to filling. In the preferred form of fitment, this membrane is molded integral with the fitment and is approximately 0.053" thick. The diaphragm is provided with a plurality of radial grooves which extend partially through the diaphragm. In the preferred embodiment, these grooves are approximately 0.015" in depth. Membrane 25 is spaced inwardly from the outer annular rim 26 of the neck, for examle, by ¼". A bevelled shoulder 29 is formed at the juncture of membrane 25 and neck 22. The external surface of neck 22 is configurated to form a standard 63-400 "M" style thread. This thread is adapted to receive a standard 63 mm screw cap 27.

In a preferred embodiment, bag 10 also carries a heat shield 19. This heat shield is of annular configuration and is formed of laminate of aluminum foil and polyethylene, preferably an L.L.D.P.E. type, 3 mils thick. The heat shield has a circular opening which is of smaller diameter than fitment flange 24. As a result, the heat shield 19 can be stretched over flange 24 and placed in contact with the outer wall of bag 10. The heat shield thereafter remains in place covering the wall of the bag adjacent to fitment 18. The function of heat shield 19 is to protect the bag as well as the bag-to-fitment seal from excessive heat build up during steam sterilization so that the interior plys of the bag do not tack together.

The details of construction of flexible containers especially adapted for use in the present system are disclosed in the application for United States patent entitled "Flexible Walled Container Having Membrane Fitment For Use With Aseptic Filling Apparatus", filed Aug. 20, 1982, under Ser. No. 409,903, now U.S. Pat. No. 4,445,550.

As explained in detail below, after filling, bag 10 is sealed by means of a circular disc, or lid, 28 which is placed over the neck 22 and is heat sealed to the outer rim 26. Disc 28 is preferably formed of a multilayer material, including a layer of low density polyethylene and a layer of aluminum foil which are adhesively bonded together.

Figure 1:
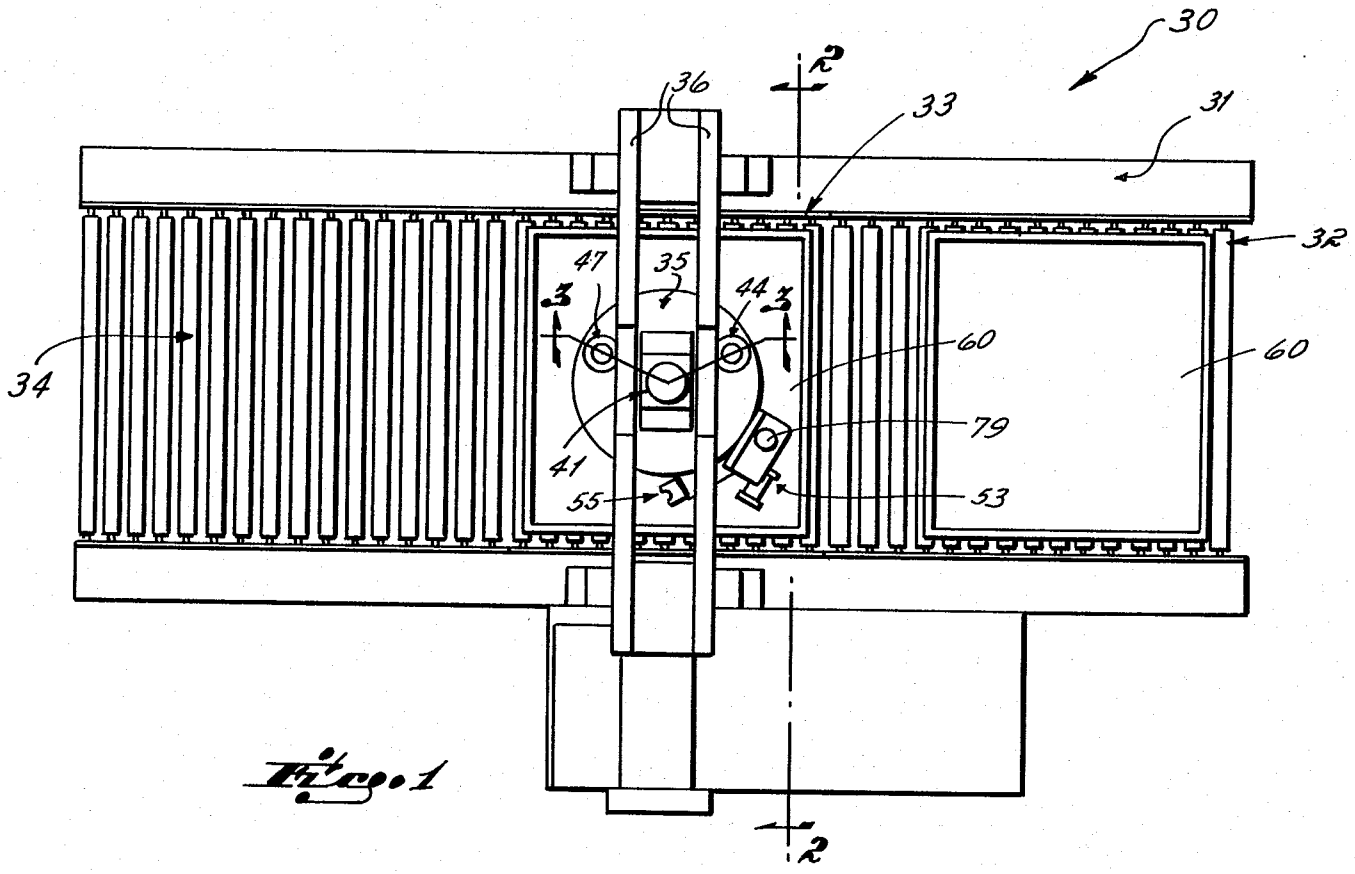
FIG. 1 is a top plan view of a filling machine embodying the present invention.
Figure 2:
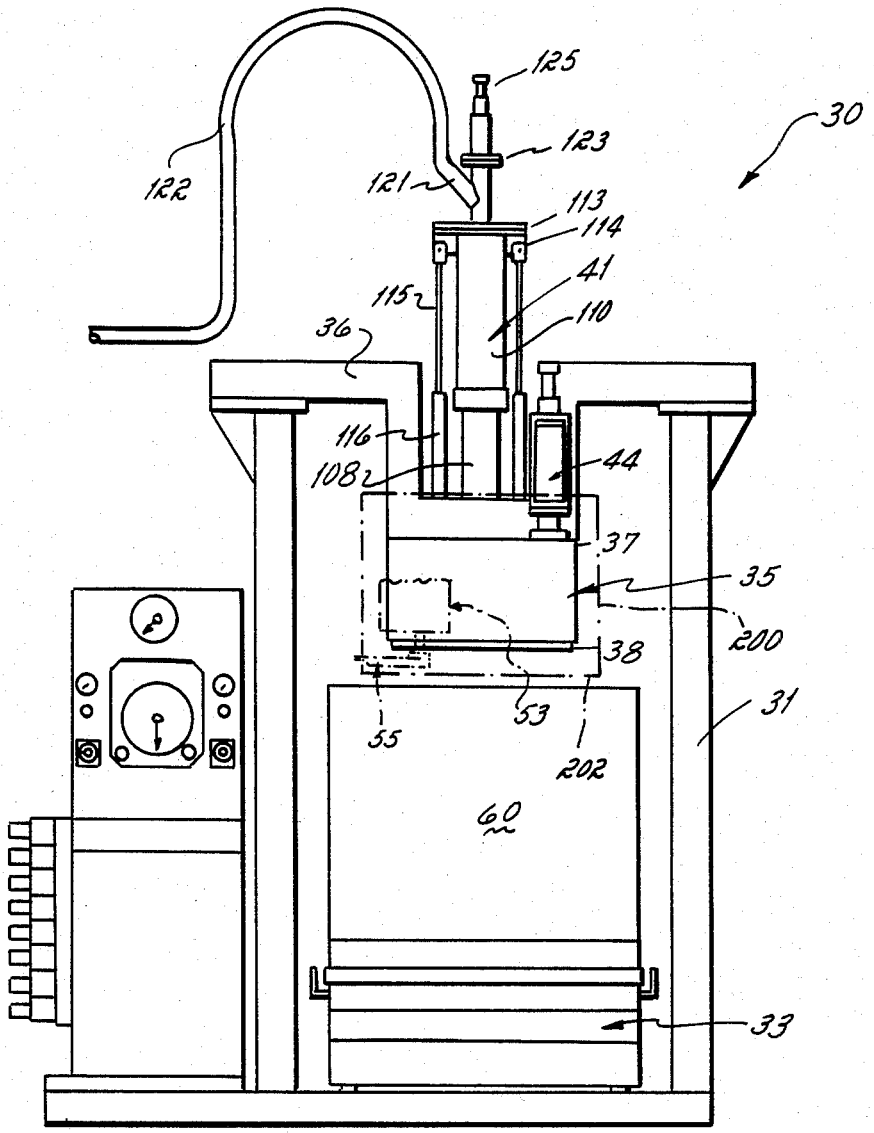
FIG. 2 is a cross-sectional view taken along line 2—2 of FIG. 1.
Figure 3:
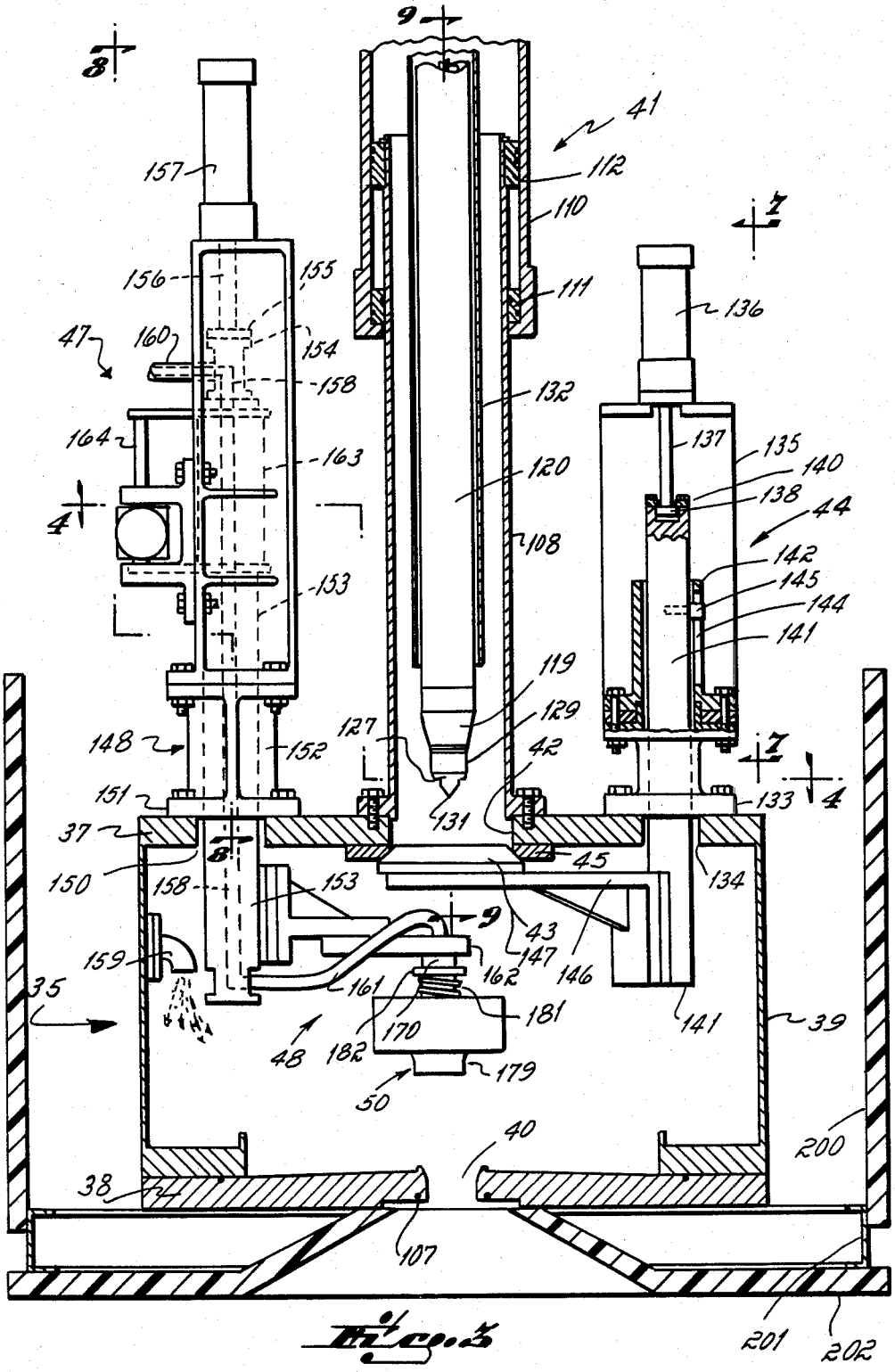
FIG. 3 is a cross-sectional view taken along line 3—3 of FIG. 1.

The overall construction of a filling machine 30 of the present invention is best shown in FIGS. 1–3. As there shown, the machine includes a frame 31 which supports an inlet, or feed, roller conveyor section 32, a lift table 33 and a discharge roller conveyor section 34. Lift table 33 is positioned beneath a filling chamber 35 which is mounted upon horizontal supports 36 extending transversely across the lift table.

In the embodiment shown, filling chamber 35 is generally cylindrical and includes an upper wall 37 and a lower wall, or platen, 38 interconnected by a vertical peripheral wall 39. A filling tube assembly 41 is mounted above a circular opening 42 in the center of upper wall 37. As explained in detail below, clamping jaw means are provided for holding a bag 10 beneath the filling chamber 35. When the bag is so positioned, the bag fitment 18 is located in central opening 40 in platen 38. The fill tube assembly includes means for puncturing the frangible membrane 25 of a bag held in opening 40 by the clamping jaws and means for introducing product into the bag. The fill tube assembly is adapted to be sealed off from the filling chamber by closing circular opening 42. This opening is closed by a closure member 43 carried by an actuator 44 which is in turn mounted upon upper wall 37. Actuator 44 is effective to pivot closure member 43 about the axis of the actuator and to raise it into a sealing position in which it engages an annular seat 45 surrounding opening 42. The actuator 44 is also effective to lower closure member 43 and to pivot it to a storage position in which it is spaced free from opening 42 as indicated by dotted lines 46 in FIG. 4.

Upper wall 37 of the sealing chamber also carries an actuator 47 for lid positioning and sealing mechanism 48. This mechanism includes a vacuum head 50 mounted within the filling chamber for lifting a lid 28 from a container to be filled and shifting the lid to a position remote from opening 40 in platen 38 (as indicated by dotted lines 52 in FIG. 4) where the lid is held, while the filling chamber, bag fitment and lid are sterilized. Actuator 47 is thereafter effective to pivot vacuum head 50 and the lid 28 which it is carrying to a position over opening 40. The actuator next lowers head 50 and lid 28 so that the lid is brought into contact with the upper rim 26 of the fitment of the filled bag and heat sealed to the rim.

A fitment clamp jaw actuator 53 is mounted adjacent to the peripheral wall 39 of the filling chamber. This actuator can be supported in any suitable manner, for example, by means of a bracket arm 54 (FIG. 5). Clamp jaw actuator 53 carries a first clamp jaw 55 which can be reciprocated toward and away from the center of opening 40 and can be pivoted to a position remote from the opening as indicated by dotted line 56 in FIG. 4. As is explained in detail below, clamp jaw 55 is adapted to cooperate with a secondary reciprocating clamp jaw 57 to engage the undersurface of intermediate flange 24 of the bag fitment 18 to hold the fitment in position within opening 40 and in sealed engagment with the platen 38.

While being filled, bag 10 is supported on the lift table within a shipping box 60. Box 60 is constructed of any suitable material, such as plywood and is of generally square outline configuration with an open top. It is desirable to line the box 60 with a smooth slick material, such as fiberboard, so no rough edges can damage the bag, and so the bag is free to slip and move as it fills. The bag is oriented within the box with fitment 18 uppermost.

Boxes 60 are fed to a position on the lift table from the inlet conveyor 32. Once on the lift table the boxes are positioned directly beneath the filling chamber 35 and are adapted to be raised or lowered by raising or lowering the lift table using any suitable means, such as a hydraulic cylinder and piston illustrated diagrammatically at 61 in FIG. 11.

Figure 4:
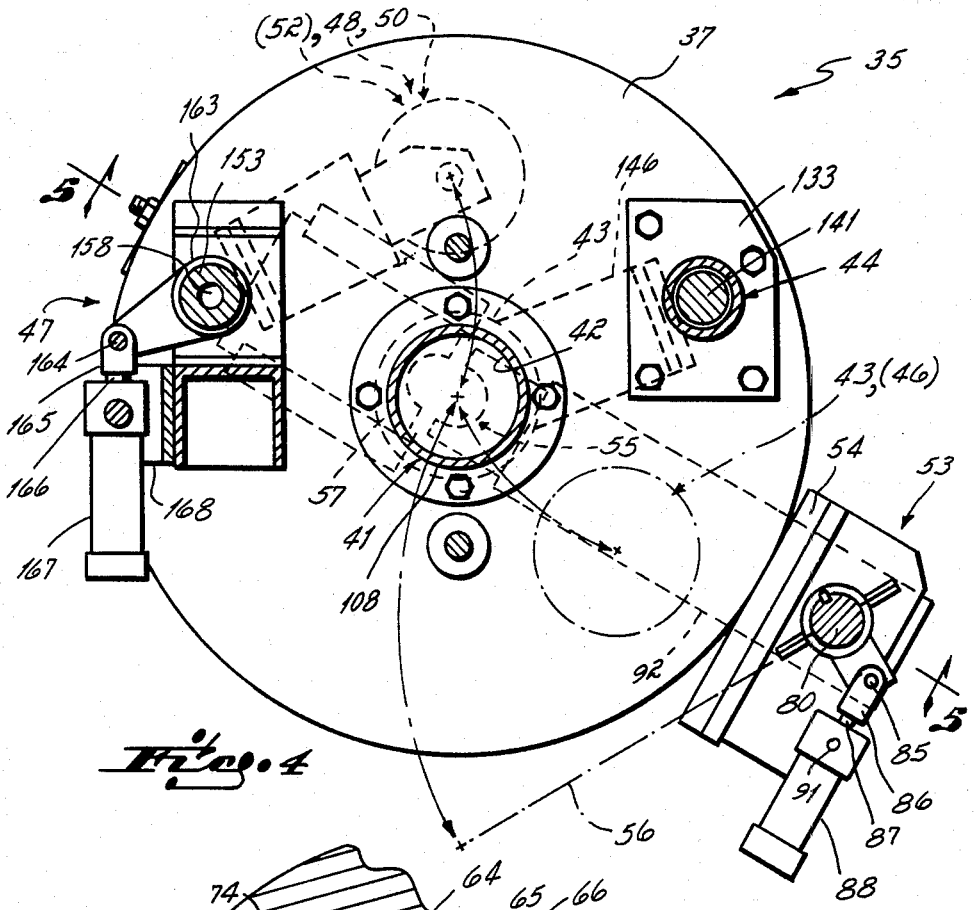
FIG. 4 is a cross-sectional view taken along line 4—4 of FIG. 3.
Figure 6:
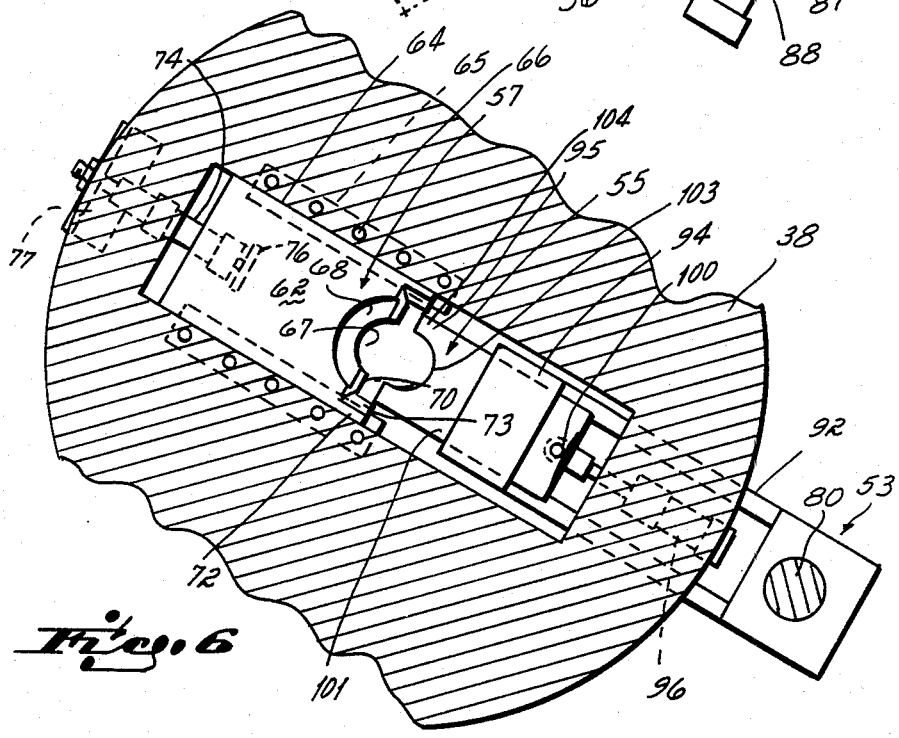
FIG. 6 is a cross-sectional view taken along line 6—6 of FIG. 5.
Figure 5:
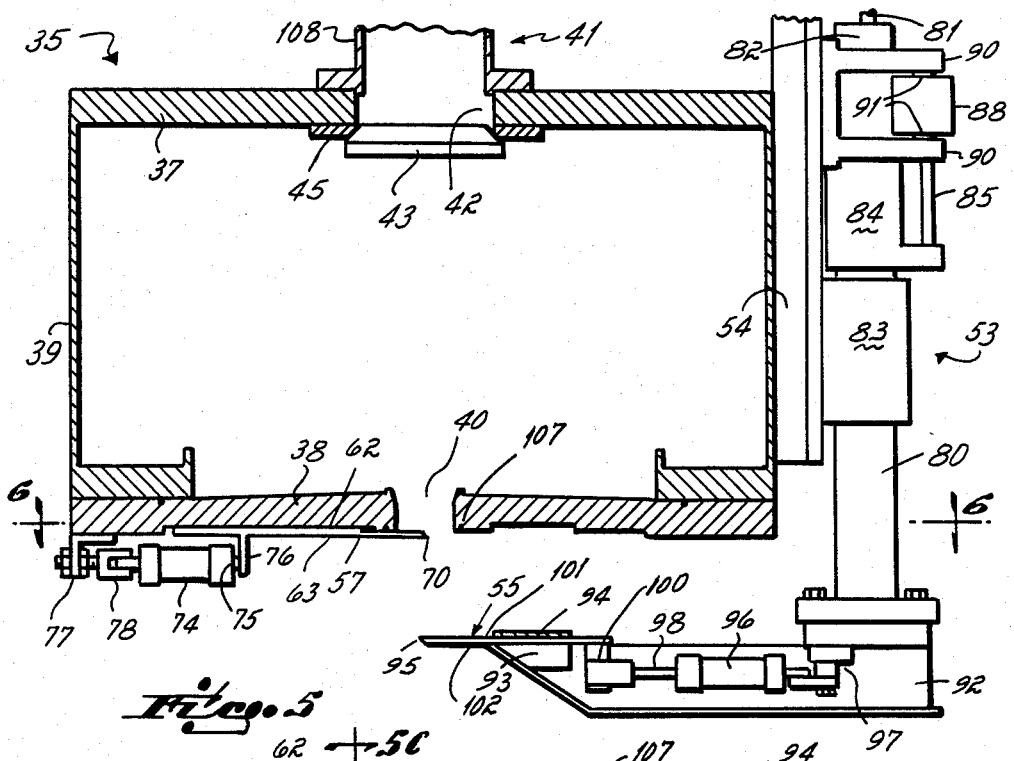
FIG. 5 is a cross-sectional view taken along line 5—5 of FIG. 4.

The details of the bag clamping mechanism are best shown in FIGS. 4–6. As there shown, the clamping mechanism comprises a reciprocating clamping jaw 57 mounted beneath platen 38. Jaw 57 has a flat upper face 62 and a flat lower face 63. The jaw reciprocates in a groove 64 machined into the undersurface of the platen and is guided by two restraining strips, or gibs, 65 which are bolted to the platen as by means of bolts 66. These strips prevent vertical movement of the jaw. The inner portion of jaw 57, i.e., the portion adjacent opening 40, has a semicircular cut-out portion 67 surrounded by a flange 68.

The thickness of flange 68 is approximately 0.225", which distance is slightly less than the 0.250" spacing between the intermediate flange 24 and lower flange 20 of bag fitment 18. The leading edges 70 of annular flange 68 are tapered downwardly and outwardly at 45° from upper face 62 of the jaw in the direction of the axis 71 of the jaw.

Figure 5A:
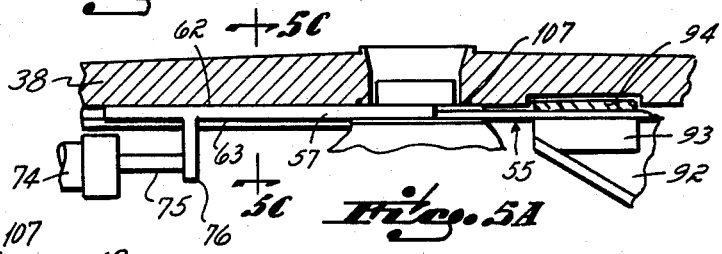
FIG. 5A is an enlarged cross-sectional view through the platen and clamping jaws similar to FIG. 5 except that in FIG. 5A both jaws are shown clamped around a bag fitment.
Figure 5B:
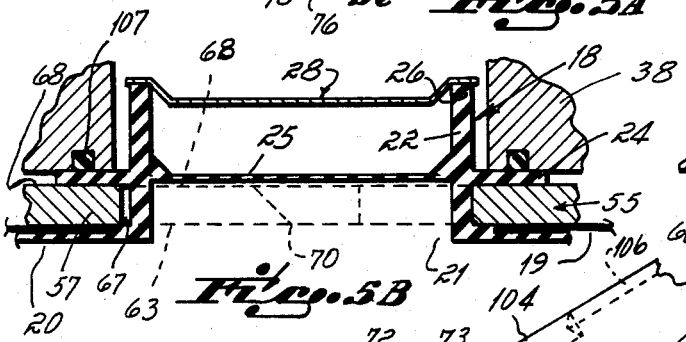
FIG. 5B is an enlarged, vertical, cross-sectional view through the platen opening showing the manner in which a bag fitment is clamped in position.
Figure 5C:
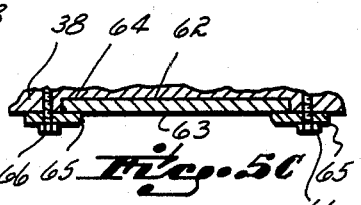
FIG. 5C is a cross-sectional view taken along line 5C—5C of FIG. 5A.

Jaw 57 further comprises two extensions 72 which project parallel to axis 71 outwardly beyond cut-out 67. These extensions include transversely tapering walls 73 which taper inwardly and downwardly at 45° from upper face 62 toward axis 71. Jaw 57 is adapted to be advanced to a position in which it extends approximately half way across opening 40 as illustrated in FIGS. 5A and 5B and to be retracted to a position in which it is withdrawn from interference with opening 40, and from interference with the intermediate fitment flange 24.

The position of jaw 57 is controlled by means of a hydraulic cylinder 74 having a piston 75 connected to a depending flange 76 carried by jaw 57. Cylinder 74 is mounted upon an angle bracket 77 secured to platen 38 in any suitable manner, such as by means of coupling 78.

The pivotal jaw 55 is carried by actuator 53. More particularly, as shown in FIG. 5, actuator 53 includes a vertical shaft 80 which is adapted to be shifted up and down by means of a hydraulic cylinder 79 (FIG. 1) enclosing a piston connected to rod 81. Rod 81 is joined to shaft 80 through a thrust bearing 82 which is effective to transmit force in a vertical direction from piston rod 81 to shaft 80, while permitting rotation of shaft 80 relative to the piston rod. Shaft 80 is journalled in a journal 83 carried by support arm 54. A sleeve member 84 surrounds shaft 80 and is rigidly secured thereto for both rotational and reciprocating movement therewith. Sleeve member 84 carries a parallel spaced vertical rod 85 which is slidably engaged by a bracket 86 mounted on piston rod 87 associated with hydraulic cylinder 88 (FIG. 4).

Cylinder 88 is carried between mounting arms 90 which are in turn secured to mounting plate 54. Cylinder 88 is pivotally mounted to arms 90 by means of two vertical pivot pins 91 which extend above and below the cylinder and are received in suitable bearings carried by the arms 90. Thus, hydraulic cylinder 88 is effective to advance and retract piston rod 87, and through its connection with shaft 85, to cause rotation of shaft 80 about its vertical axis.

A horizontal cantilever arm 92 is mounted in any suitable manner upon the lower end of shaft 80. This cantilever arm carries at its outer arm clamping jaw 55. Clamping jaw 55 is mounted for reciprocating movement along the axis of cantilever arm 92. The clamping jaw 55 is supported by a lower block 93 and is guided by means of a channel-shaped guide block 94 having an opening of rectangular configuration extending along the axis of cantilever arm 92. Guide block 94 is effective to constrain clamping jaw 55 to reciprocating axial movement along arm 92 while permitting very limited upward tilting movement of the free end 95 of clamping jaw 55. The jaw is moved in and out by means of a hydraulic cylinder 96 which is rigidly connected to the lower end of shaft 80 and cantilever arm 92 as at 97. This cylinder includes piston rod 98 which is connected to jaw member 55 through a pivot rod 100.

Figure 5D:
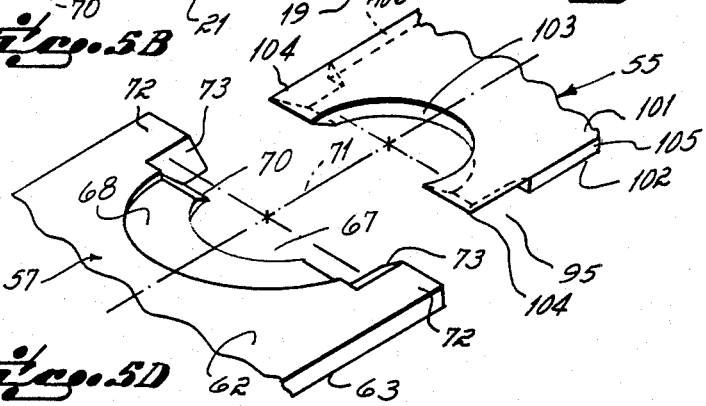
FIG. 5D is a partial perspective view of the fitment-engaging clamp jaws.

As shown in FIGS. 5B and 5D, jaw 55 is of generally rectangular cross-section having a flat upper face 101 and a flat lower face 102. The portion of the jaw adjacent to opening 40 in platen 38 is provided with a circular removed portion 103 and axial extensions 104 disposed in either side of the removed section. These extensions are provided with a downwardly and rearwardly bevelled surface extending from the free end of the jaw. The bevel is at an angle of 45° to match the bevel along edge 70 of jaw 57. The forward portions of the side edges 105 and 106 are also bevelled downwardly and inwardly at an angle of 45° to mate with surfaces 73 of jaw 57. The axial extensions 104 of the jaw 55 extend beyond the center of the circular removed portion 103 so the opening is reduced to less than the diameter of the fitment neck 22, thus necessitating that the fitment be "snapped" into place.

In order to support a bag for filling, the fitment 18 of a bag is inserted in semicircular opening 103 of jaw 55 in such a manner that the jaw member surrounds the neck portion 22 between the intermediate flange 24 and lower flange 20. The cantilever arm 92 is then rotated and jaw 55 advanced by means of cylinder 96 until the fitment 18 is in alignment with opening 40 in platen 38.

Then the vertical cylinder 79 acting through piston rod 81 raises shaft 80, cantilever arm 92 and jaw 55 to insert the fitment 18 into opening 40 as shown in FIG. 5B. Secondary jaw 57 is then shifted from a position spaced from opening 40 into the position shown in FIG. 5B in which it embraces neck 22 of the fitment between intermediate flange 24 and bottom flange 20.

As secondary jaw 57 is advanced, its bevelled surfaces 70 and 73 engage the cooperative surfaces on clamping jaw 55 forcing that jaw upwardly to clamp intermediate flange 24 against the bottom surface of platen 38. In the preferred embodiment, the clamping force generated by these bevelled surfaces is of the order of 600 pounds. The engagement under this appreciable clamping force of intermediate flange 24 with the bottom surface of platen 38 and the compression of a sealing ring 107 mounted in the bottom wall of the platen forms a fluid-tight seal between the platen and the exterior of fitment 18.

In filling such large bags as the 300 gallon unit, it is important to prevent the bag from folding on itself while filling, as this would reduce the available volume of the bag. It is also necessary to protect the bag from the hot surfaces of the fill chamber. For these purposes, the fill chamber is surrounded by a plastic-sided box 200. The side walls of this box are outfitted with spring-loaded clamps (not shown) which are used to hold the bag tightly to the plastic enclosure after the fitment has been placed into the fill chamber opening 40, while the shipping box 60 is raised around the fill chamber.

More particularly, as shown in FIG. 3, box 200 comprises four upstanding planar walls formed of a suitable plastic material. These walls are secured to a suitable frame 201 in any suitable manner. Frame 201 is preferably formed of channel members and is mounted upon the lower surface of platen 38 as by means of suitable bolts. Plastic box frame 201 also carries a plastic sub-platen 202 formed of Lexan, or the like, which insulates bags 10 from the metal platen 38. It is to be understood that both frame 201 and sub-platen 202 are provided with an elongated removed section extending from their periphery to an opening aligned with opening 40 to permit in and out movement of clamping jaw 57. It is also to be understood that frame 201, sub-platen 202 and box 200 have been omitted from FIGS. 5, 9 and 12, and have been shown in phantom in FIG. 2 for purposes of clarity.

As filling of the bag proceeds, the weight of the product easily pulls the bag from the spring clips. To prevent the bag from folding on itself during filling, it is necessary to completely fill that portion of the bag which extends into the annular space between the shipping box 60 and the plastic enclosure. Side pressure of the product in the bag against the annular walls supports the bag. As a further aid, the bottom plastic platen extends beyond the channel frame for the plastic enclosure, thus forming a lip which helps prevent the bag from dropping excessively as the shipping box is lowered.

The details of construction of fill tube assembly 41 are best shown in FIGS. 2, 3, 5 and 9. As there shown, the fill tube assembly includes an upstanding guide tube 108 which is bolted or otherwise secured and sealed to the upper wall member of the filling chamber surrounding an opening 42. A movable outer tube 100 surrounds guide tube 108. Tube 110 carries at its lower end a packing ring assembly 111 of any suitable construction for forming a fluid-tight seal between outer tube 110 and guide tube 108. Guide tube 108 similarly carries at its upper end a packing ring assembly 112 for providing a second fluid-tight seal between tubes 108 and 110. Tube 110 is secured and sealed at its upper end to a plate 113. This plate is in turn connected through coupling members 114 to piston rods 115 associated with the hydraulic cylinders 116.

More particularly, each of the coupling members 114 includes an upstanding stud 117 which passes upwardly through a bearing sleeve fitted in a bore in plate 113. A compression spring 118 surrounds each of the studs 117 and is compressed between plate 113 and lock nuts 117A. The compression springs serve to control the downward force of the fill tube when it seats against the fitment. Cylinders 116 are preferably rigidly mounted to the upper wall 37 of the filling chamber and provide means for raising and lowering tube 110 and the various components which it carries. Plate 113 is provided with a central opening which receives a vertical fill tube 120. The juncture between fill tube 120 and plate 113 and tubes 108 and 110 form a housing for the portion of fill tube 120 below plate 113. Fill tube 120 is preferably of circular cross-section. At its lower end it includes an inwardly tapered portion 119 and a lowermost tubular section 129 of reduced diameter. Fill tube 120 extends upwardly above plate 113 and is joined with a tube 121 adapted to be interconnected to flexible feed tube 122 through which product is pumped into fill tube 120.

The upper end of fill tube 120 also carries a flange 123 above which is mounted a hydraulic cylinder 125 having a piston rod connected to fill valve actuating rod 126. Actuating rod 126 extends downwardly through the fill tube to a pear-shaped valve member 127. This member is adapted to be raised so that its upper frusto-conical surface 128 seals against a cooperating seat 130 formed at the lower end of the fill tube. The lower portion of valve 128 tapers downwardly to form nose 131.

An intermediate tube 131 surrounds fill tube 120 in spaced relation thereto. Intermediate tube 132 is secured at its upper end to plate 113 and extends downwardly in concentrically spaced relationship to fill tube 120. The lower end of intermediate tube 132 is spaced from the bottom of the fill tube so that when the fill tube is in this lowermost position, intermediate tube 132 remains spaced above platen 38.

Figure 9:
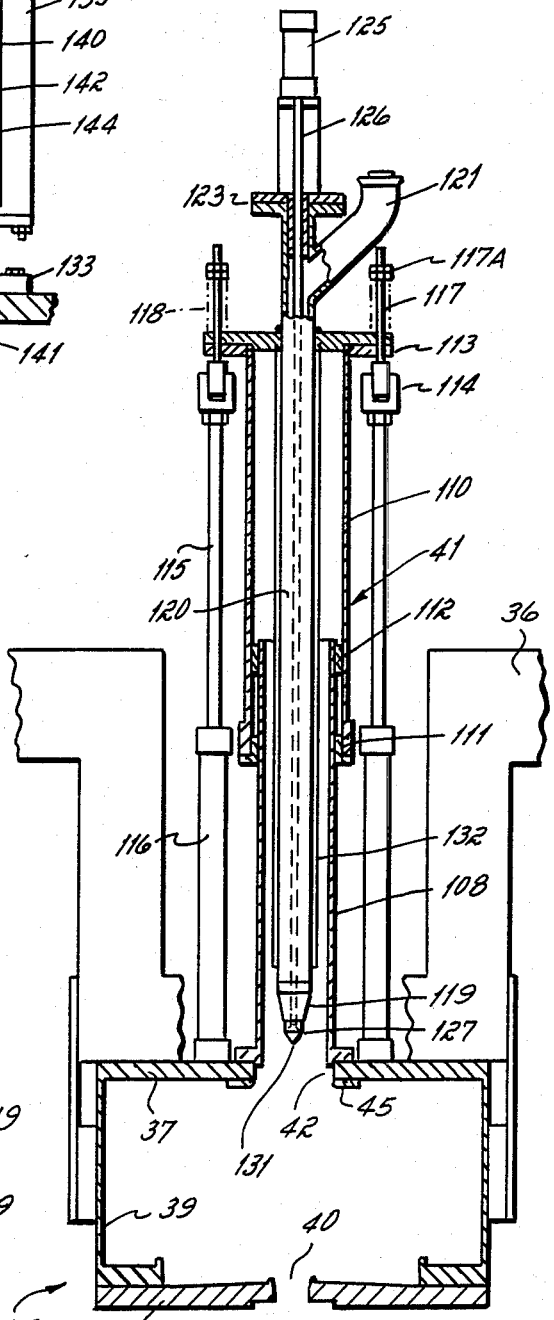
FIG. 9 is a cross-sectional view taken along line 9—9 of FIG. 3.
Figure 10:
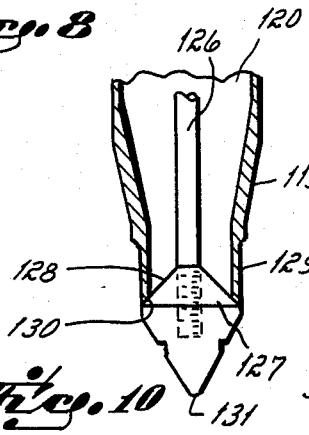
FIG. 10 is an enlarged sectional view of the lower end of the fill tube and valve.
Figure 11:
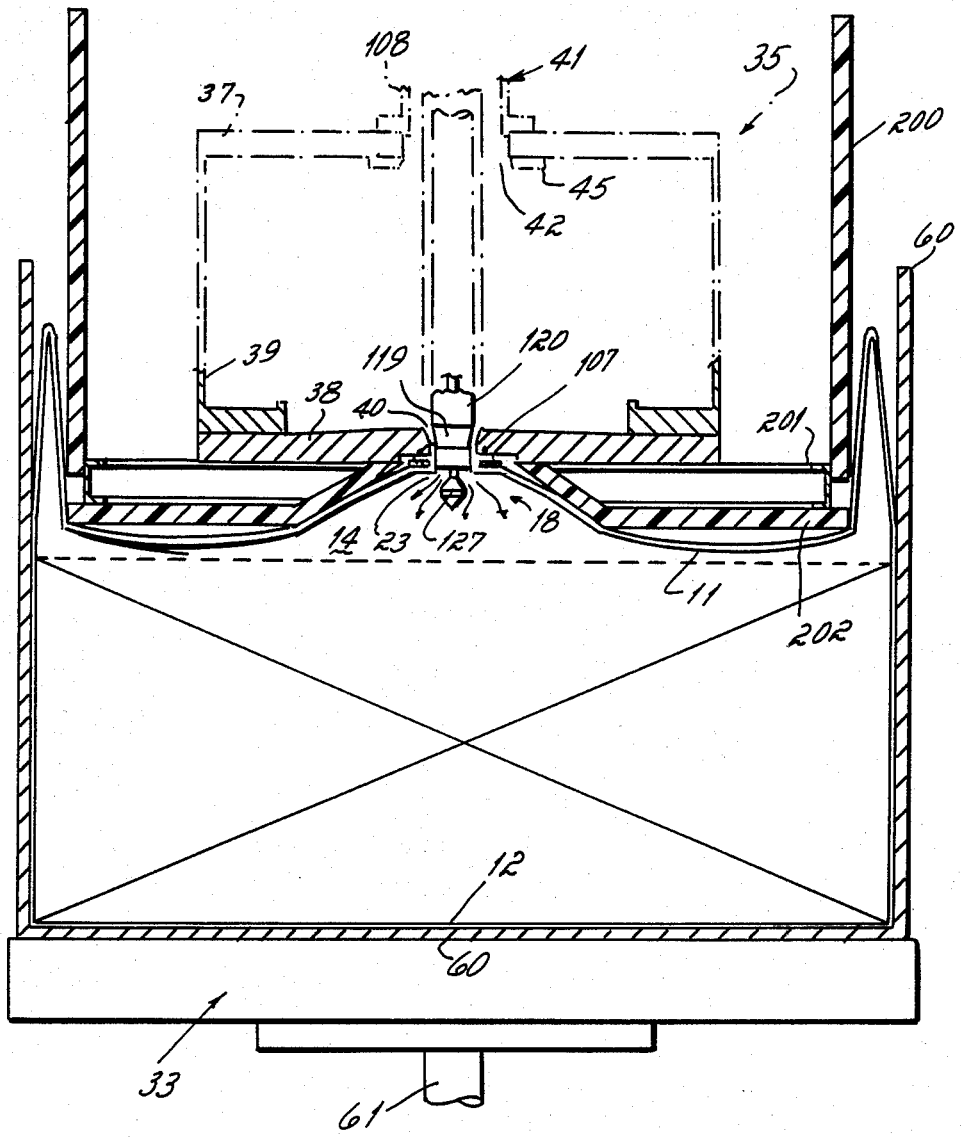
FIG. 11 is a vertical cross-sectional view through the filling chamber and a bag and shipping box showing the bag in a partially filled condition.

Fill tube 120 is adapted to be raised to a storage position within its housing as illustrated in FIGS. 3 and 9. In this position, the fill tube below plate 113 is entirely disposed within guide tube 108 and outer tube 110 and nose 131 is spaced above upper wall 37. The fill tube can also be shifted to its lowermost, or filling, position as illustrated in FIG. 11. In this position, the tapered section 119 engages and seals against the bevelled shoulder 29 (FIG. 14) of a bag fitment 18, thereby preventing any food product from contaminating top rim 26 of the fitment. When the fill tube is in its filling position, nose 131 is brought into contact with a frangible membrane 25 and is effective to rupture that membrane to provide access to the interior of the bag 10. When shaft 126 is lowered, for example, by 1½", valve 127 opens so that food product is free to flow downwardly through fill tube 120 and around the valve member into the bag 10 as illustrated in FIG. 11.

After the bag has been filled, actuator rod 126 is raised to elevate valve member 127 into its closed position in contact with seat 130. The fill tube can then be raised by means of cylinders 116 until it is totally withdrawn from the filling chamber into the fill tube housing as shown in FIG. 9. At that time, the fill tube and the fill tube housing, i.e., the interior of tubes 108 and 110, can be sealed from the filling chamber by closure member 43 which is shifted to its closed position, closing opening 42 by actuator 44.

Preferably at this point in the cycle, the exterior surface of the fill tube 120 is rinsed by flowing condensed steam over it. This condensate is introduced around the tube through cross-plate 113 through a suitable inlet connection (not shown), and via the annulus between fill tube 120 and intermediate tube 132. A suitable drain tube (not shown) for this condensate is connected to the interior of the guide tube 108 either through closure member 43 or the base of tube 108.

Figure 7:
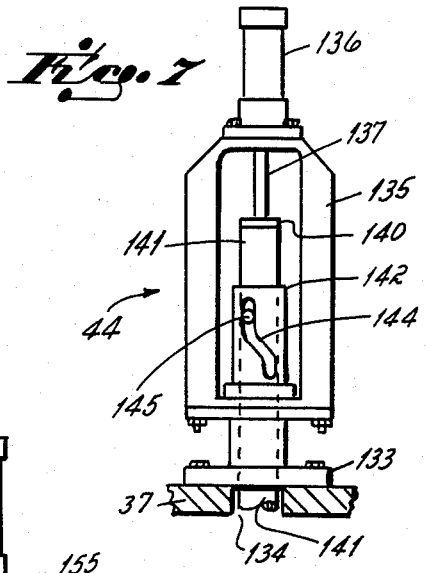
FIG. 7 is an elevational view of the filling tube closure member actuator taken along line 7—7 of FIG. 3.

The details of actuator 44 are shown in FIGS. 3 and 7. As there shown, actuator 44 includes a support base 33 which is bolted or otherwise secured to the top wall 37 of the fill chamber over an opening 134 formed in that wall. The base is sealed to the top wall by means of suitable sealing rings (not shown). Base 133 carries a cylinder mounting bracket 135 which supports a vertical cylinder 136. Cylinder 136 has associated therewith a piston rod 137 which extends downwardly and carries a flange 138 on its lower end in engagement with a thrust bearing 140. Thrust bearing 140 is carried at the upper end of a shaft 141 which is journalled for rotating and reciprocating movement in a suitable journal bearing carried by base 133. Suitable sealing rings (not shown) are interposed between shaft 141 and base 133 to provide a fluid-tight seal.

Base 133 also carries an upstanding cylinder 142 having a cam track 144 machined therein. Cam track 144 receives a follower 145 which extends outwardly from shaft 141. The configuration of the cam track 144 is such that when shaft 141 is lowered a sufficient distance, such that disc 43 clears seat 45, shaft 141 is rotated counterclockwise in FIG. 4 to swing the closure member to its storage position 46.

As shown in FIG. 3, closure member 43 is mounted upon a radial arm 146 carried by the lower end of shaft 141. The closure member is of circular outline configuration and is provided with a frustoconical sealing surface 147 adapted to seat against the mating face of seating ring 45. The seating ring 45 is machined and fitted to a drain line (not shown) which accepts the condensate which is used to wash the fill tube.

In addition to the elements previously described, upper wall 37 of the filling chamber also supports a mounting bracket 148 of actuator assembly 47 for the lid positioning and sealing mechanism 48. Bracket 148 is mounted above an opening 150 in the upper wall and includes a flange 151 which surrounds the opening. Suitable sealing rings (not shown), carried by the flange, provide a fluid-tight seal between the flange and upper wall 37 surrounding the opening. Bracket 148 includes a journal section 152 which journals shaft 153 for rotary and vertically reciprocating movements. Suitable sealing rings (not shown) are interposed between the journal section and shaft to provide a fluid-tight seal. The upper end of shaft 153 is joined through a coupling member 154 and thrust bearing 155 to the piston rod 156 of hydraulic cylinder 157.

Shaft 153 contains an axial bore 158. At the upper end of this shaft, the bore connects to a radial port which receives vacuum tube 160 connected to a suitable vacuum pump. The lower end of shaft 153 contains a transverse port which is connected to a vacuum connector line 161 which serves to interconnect bore 158 with vacuum head 50. Vacuum head 50 is carried by a horizontal support arm 162 extending horizontally from the lower end of shaft 153. Cylinder 157 is effective to raise and lower shaft 153, arm 162 and vacuum heat 50.

Figure 8:
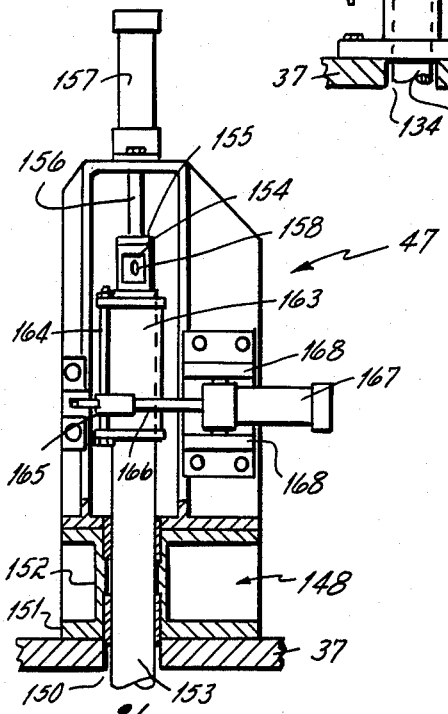
FIG. 8 is a view partially in section of the vacuum head actuator taken along line 8—8 of FIG. 3.

A collar member 163 (FIG. 8) is secured about the periphery of shaft 153. This collar member carries a vertical shaft 164 which is received within an opening in connector 165 carried by the free end of piston rod 166 associated with hydraulic cylinder 167. Cylinder 167 is pivotally mounted between the horizontal arms of angle brackets 168 carried by support bracket 148. Cylinder 167 carriers vertical pins which are rotatably journalled in bearings carried by the bracket arms. Cylinder 167 is thus effective to cause rotation of shaft 153 and support arm 162 to shift vacuum head 50 from a position in which it is aligned with opening 40 in platen 38 to a storage position in which it is remote from that opening as illustrated at 52 in FIG. 4.

Figure 12:
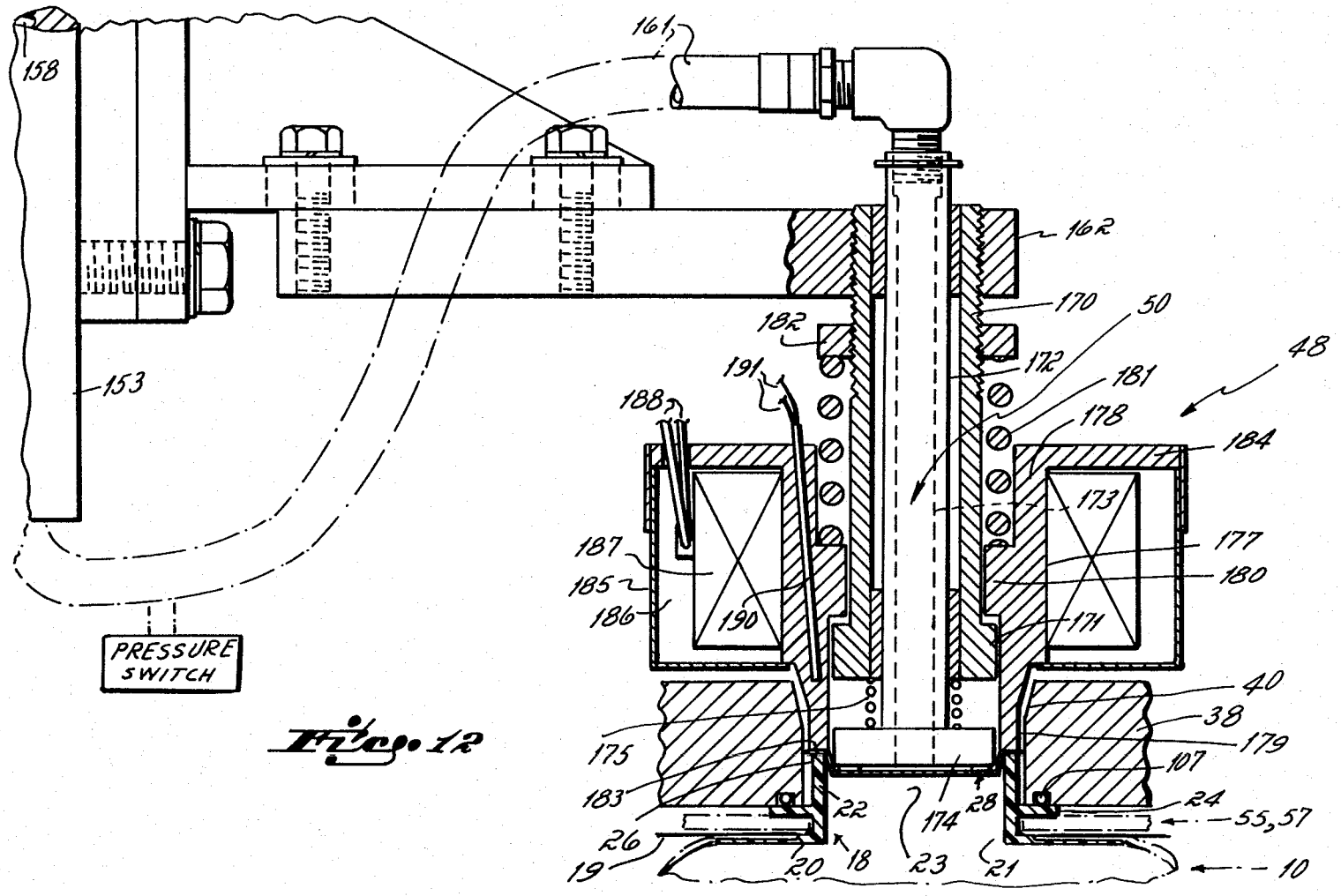
FIG. 12 is a cross-sectional view through the heat sealing unit showing the unit sealing a lid onto the fitment of a bag.

The details of heat sealing unit 48 and vacuum head 50 are best shown in FIG. 12. As there shown, the vacuum head comprises a vertical support tube 170 which is threadably connected at its upper end to support arm 162. The lower end of tube 170 includes a horizontal flange 171 of a slightly smaller diameter than the inner diameter of neck 22 of fitment 18. Support tube 170 carries a vacuum tube 172 which includes a vertical bore 173. Bore 173 extends throughout the length of tube. A flange 174 is formed on the end of tube 172, the flange being of substantially the same diameter as flange 171. A light compression spring 175 is compressed between flanges 171 and 174.

Vacuum head assembly 50 also carries heat sealing unit 48. This unit includes a heat seal platen member 177. Platen 177 includes a tubular section 178 which surrounds support tube 170. Tubular section 178 is provided with an inwardly extending flange 180 adapted to abut lower flange 171.

A heavy spring 181 surrounds support tube 170 and is compressed between flange 180 and an adjustment nut 182. As a result of this construction, platen 177 is spring urged downwardly relative to support arm 162, but is free to move upwardly relative thereto against the force of spring 181. Platen member 177 is further configurated to form a depending skirt 179 which terminates in a horizontal annular heat sealing surface 183. This surface has an outer diameter larger than the outer diameter of neck 22 of fitment 18 and an inner diameter smaller than the inner diameter of the fitment so that the heat sealing surface 183 is adapted to completely overlie top rim 26 of fitment 18 as shown in FIG. 12.

Heat sealing platen member 177 includes an outwardly extending top wall 184 which supports a cover member 185 having a peripheral wall and a bottom wall adapted to form with the platen member an annular chamber 186. Chamber 186 receives a suitable heating element 187, such as a Chromalox band heater rated at 125 volts and 675 watts. This heating element is adapted to be connected through leads 188 to a suitable power supply. The platen further has embedded therein a suitable temperature probe 190, such as a Fenwall Thermistor Probe, Style C, with a range of from 200° F.–600° F. This probe is connected through leads 191 to a suitable control for controlling the energization of heater unit 187 to maintain a desired temperature of the heat sealing platen.

Vacuum head 50 is initially spaced above and away from alignment with opening 40. After a bag fitment 18 has been locked in position in opening 40, cylinders 157 and 167 are effective to rotate and lower the vacuum head to bring flange 174 into contact with a foil disc, or lid, 28 which is resting on top of rim 26 of the fitment. It should be noted that flange 174 extends an appreciable distance below sealing surface 183 of the platen so that the foil disc remains spaced from this surface. When the foil disc has been captured by the vacuum applied through bore 173, a drop in pressure is sensed by a pressure switch shown diagrammatically in FIG. 12. This switch is responsive to the pressure in vacuum tube 161. Only if the switch is actuated to confirm that a disc has been picked up, cylinders 157 and 167 elevate arm 162 and vacuum head 50 and return it to its storage position spaced from opening 40 (indicated at 52 in FIG. 4). Thereafter, after the bag 10 has been filled and the filling tube withdrawn, cylinders 157 and 167 again rotate arm 162 and the vacuum head into alignment with opening 40. Foil lid 28 is returned to a position in which it covers the neck 22 of fitment 18. Further downward movement of arm 162 causes platen 177 to compress lid 28 against the rim 26 of fitment 18. The force of this compression is controlled by spring 181. The heated platen is maintained in contact with lid 28 a sufficient time to effect a heat seal between the fitment 18 and lid 28. Thereafter, the vacuum is removed from bore 152 by actuating a suitable valve in the vacuum line and cylinders 157 and 167 coact to raise head 50 and rotate it to its storage position prior to the commencement of the next cycle.

When filling bags in accordance with the present invention, bags 10 are supplied with their frangible membranes intact. The bags are presterilized in any suitable manner, for example, by subjecting them to gamma radiation. A presterilized bag is draped over a box 60 and the box is placed on the feed roller conveyor section 32. The box is then moved to the fill station by shifting it onto the lift table 33. A lid 28 is placed on fitment 18 and the fitment is placed in the clamping jaw 55 with the jaw being inserted between the flanges 24 and 20 of the fitment 18. The jaw 55 is then pivoted by means of cylinder 88 until fitment 18 is in alignment with opening 40 in the platen. Arm 92 and jaw 55 are then raised by cylinder 79 to bring the fitment into position within opening 40 as shown in FIG. 5A.

With the fitment located within opening 40, secondary jaw 57 is advanced by cylinder 74 until the bevelled surfaces of jaws 57 and 55 are in engagement with one another as shown in FIG. 5B. As a result of the interengagement of these bevelled surfaces, jaw 55 is forced upwardly to compress flange 24 against platen 38 with an appreciable force, for example, 600 pounds. As a result, opening 40 is completely sealed by the fitment 18.

During this operation, fitment 18 carries foil lid 28 which rests upon rim 26 as shown in FIG. 5B. The depressed center section of the lid helps to keep the lid in place. During the initial portion of the operating cycle, fill tube 120 is in its elevated, retracted position within the fill tube housing formed by guide tube 108 and outer tube 110. Opening 42 of the fill tube housing is sealed off by member 43 which is seated against seat 45 as shown in FIG. 3. Also during the initial portion of the cycle, vacuum head 50 is in its elevated position remote from the axis of opening 40 as indicated at 52 in FIG. 4.

In the next step, vacuum head 50 is rotated by cylinder 167 and lowered by cylinder 157 to bring flange 174 and vacuum line 172 into engagement with foil lid 28. The valve in the vacuum line is opened so that the foil disc 28 is held against flange 174. Next, the vacuum head 50 is elevated by cylinder 157 and rotated by cylinder 167 to shift it and the foil lid 28 which it is carrying to storage position 52.

At this point, steam is introduced into filling chamber 35 through a suitable inlet fitting 159 (FIG. 3) which can be closed when desired by means of a valve (not shown). This steam is effective to sterilize the foil disc 28, the exposed surface of membrane 25 and the exposed portions of fitment 18, as well as fill chamber 35. At the completion of the steam sterilization cycle, the steam pressure is decreased from approximately 15–30 psi to a 0.5 psi. Alternately, nitrogen is introduced within the fill chamber to maintain this pressure.

In the next step, closure member 43 is lowered and rotated free from opening 42 by means of hydraulic cylinder 136. Fill tube 120 is then lowered by means of cylinders 116 until nose 131 punctures frangible membrane 25 and the tapered section 119 of the fill tube seats against, and forms a seal with, neck portion 22 and shoulder 29 of fitment 18. This seal between section 119 and the bevelled shoulder 29 prevents any food product from contacting rim 26 of the fitment.

Lift table 33 had previously been raised to elevate box 60. Fill valve 127 is opened by lowering the valve to the position shown in FIG. 11 by means of hydraulic cylinder 125 and product is pumped through the flexible product line 122 and the fill tube into bag 10. As is known in the art, a suitable pressure sensor (not shown) senses the pressure applied by the top of bag 10 against the filled platen. When this pressure reaches a set point, the lift table is automatically lowered until the pressure is released. The downward movement of the lift table is then stopped until pressure again builds up to a set point. In this manner, as the bag 10 is progressively filled, the lift table and box 60 are lowered in a step-by-step manner until the bag is completely filled, at which time the lift table is lowered into alignment with the feed conveyor section 32 and discharge conveyor section 34. This step-by-step lowering of the lift table in response to pressure build-up within bag 10 is well known and constitutes no portion of the present invention.

When the bag is filled, a suitable valve (not shown) shuts off flow of the product to the fill tube. The fill tube valve 127 is elevated by means of cylinder 125 to close the fill tube. The fill tube is then raised within its housing by means of cylinders 116. Closure member 43 is rotated and brought into engagement with seat 45 to seal the fill tube housing and the exterior of the fill tube is rinsed with steam condensate which is introduced through the annulus between the fill tube 120 and the intermediate tube 132. Steam or nitrogen is then introduced into housing 41 to establish a pressure of approximately 3 psi.

In the next step, vacuum head 50 is again rotated into alignment with fitment 18 and is lowered to place lid 28 on rim 26. It will be understood that during the storage of lid 28 and its transport away from and toward the fitment 18, the lid is held spaced from heat sealing platen 177 due to the fact that flange 174 is positioned a sufficient distance below surface 183 to provide a space between that surface and the lid. However, during the sealing operation, arm 162 moves downwardly a sufficient distance so that spring 181 forces the heat sealing platen into contact with the peripheral portion of lid 28 overlying rim 26 to effectively heat seal the lid to the rim.

After the lid 28 has been heat sealed to rim 26, the vacuum head 50 is raised and pivoted to return it to its storage position 52. The filling chamber 35 is then vented to atmosphere through a suitable valve in the steam line (not shown). Secondary jaw 57 is retracted by cylinder 74 to unclamp fitment 18. Jaw 55 is retracted to release the fitment and is pivoted to its storage position remote from opening 40 after the bag and box have been lowered beyond interference with the swing arm 92. A shipping cap 27 is threaded over neck 22 to protect lid 28 and filled container 10 and its box 60 are then shifted onto the discharge conveyor secton 34. A suitable cover is preferably applied to box 60 to ready the box for shipment.

From the above disclosure of the general principles of the present invention and the preceding description of a preferred embodiment, those skilled in the art will readily comprehend various modifications to which the invention is susceptible. Thus, it is contemplated that flexible bags having wall constructions differing from the specific wall construction disclosed can be used as part of the aseptic filling system. It is further contemplated that the present filling apparatus can be employed to fill plastic drums or other rigid containers constructed to include a membrane fitment as described herein. When filling such rigid containers, the lift table would, of course, remain stationary during the filling operation and would not be stepped downwardly as described in connection with the preferred embodiment. It is also contemplated that sterilants other than steam, for example, citric acid or hydrogen peroxide, can be utilized in place of steam to sterilize the fitting chamber prior to filling. Accordingly, we desire to be limited only by the scope of the following claims.

Having described our inventions, we claim:

1. The method of aseptically filling a container having a fitment therein, said fitment including a rigid neck, a flange on the outer periphery of said neck, a frangible diaphragm extending across said neck to seal the interior at said container and an exposed sealing rim adapted to receive a lid in heat sealed engagement disposed outwardly of said diaphragm, said frangible diaphragm being spaced inwardly from said sealing rim, said flexible container being sterilized, said method comprising the steps of:

providing an enclosed filling chamber with an opening;

securing said bag to the outside of said filling chamber by locking said flange against the chamber so that said fitment extends into and seals said opening;

holding a lid within said filling chamber apart from said fitment;

introducing steam into said filling chamber to sterilize said chamber, the exposed portion of said fitment and said lid while maintaining the interior of said flexible container free from steam;

maintaining a fill tube completely in an asceptic housing that is sealed from said chamber;

opening said housing and introducing said fill tube trough said chamber and puncturing said frangible diaphragm with said fill tube;

establishing a sealed relationship between said fill tube and the inside of said neck in a region spaced inwardly from said rim;

introducing product through said fill tube into said flexible container;

withdrawing said fill tube from said neck completely into said housing and sealing said housing from said chamber;

transporting a lid into position across said rim;

heat sealing said lid to said rim while within said chamber; and removing the neck of said container from the opening of said filling chamber.

2. The method of claim 1 further comprising the steps of:

placing a lid across said rim of said fitment prior to the time said fitment is inserted in said opening, removing said lid from contact with said rim and supporting it in a position within said filling chamber remote from said fitment; and sterilizing said lid simultaneously with the sterilization of said filling chamber and fitment.

3. The method of claim 2, comprising the further step of mounting a protective cap over said fitment after said fitment has been removed from the opening in said filling chamber.

4. The method of claim 1 further comprising the end of said fill tube being closed when said end is inserted in said fitment;

opening the end of said fill tube after said sealed relationship has been established; and thereafter closing said fill tube prior to withdrawing said fill tube from said container.

5. Apparatus for aseptically filling a flexible container having a rigid fitment secured thereto, said fitment comprising a neck, a flange on the outer periphery of said neck, an exposed sealing rim adapted to receive a lid in heat sealed relationship therewith, a frangible diaphragm extending across said neck to seal the interior of said container, said frangible diaphragm being spaced inwardly from said sealing rim, said apparatus comprising:

a filling chamber having a platen, said platen having an opening therethrough;

clamp jaw means disposed exteriorly of said filling chamber and engageable with the flange of a fitment for shifting said fitment to a position adjacent the said opening and locking said fitment against said platen surrounding the opening in said platen with the neck of said fitment being disposed in registry with and sealing said opening;

fill tube means extending into said chamber and disposed in alignment with said opening and movable toward and away from said opening, said fill tube means extending into said chamber and carrying a member for rupturing said frangible diaphragm;

said fill tube means comprises a fill tube disposed above said opening in said platen, the axis of said fill tube being perpendicular to said platen;

an asceptic housing for enclosing said fill tube in sealed communication with said filling chamber;

means for retracting said fill tube within said housing; and means for sealing said housing from said filling chamber;

said fill tube means having a portion for sealingly engaging the interior of said neck in a region spaced inwardly from said rim to prevent product discharged from said fill tube from contacting said rim;

means disposed within said filling chamber for holding a lid during the filling operation and for transporting a lid into contact with said rim;

means within said chamber for heat sealing said lid to said rim; and means within said chamber for introducing steam into said filling chamber.

6. The apparatus of claim 5 in which said means for transporting said lid includes an arm pivoted about an axis offset from the axis of said fill tube, a vacuum head carried by said arm and means shifting said vacuum head along the axis of said fill tube.

7. The apparatus of claim 6 in which said platen constitutes the bottom wall of said filling chamber and said chamber includes a top wall having an opening formed in alignment with the opening in said platen, said fill tube housing being mounted upon said top wall above said opening.

8. The apparatus of claim 6 in which said means for rupturing said frangible diaphragm comprises a valve member disposed at one end of said fill tube, said valve member being tapered at its upper end to seat against said fill tube and being tapered at its lower end to facilitate fracturing said frangible diaphragm; and said portion of said fill tube for sealingly engaging the interior of said neck comprising an external shoulder on said fill tube of a diameter greater than the diameter of said valve member; and means for reciprocating said valve member from a closed position in contact with said fill tube to an open position spaced therefrom.

9. The filling apparatus of claim 7 further comprising a lift table for supporting a container beneath said filling chamber and shifting said container toward and away from said filling chamber.

10. The filling apparatus of claim 5 in which:

said clamping jaw means comprise a pivotal jaw and a secondary jaw;

said secondary jaw having a circular portion for surrounding the neck of a fitment, a flange for engaging the aforesaid flange of said fitment and holding said flange against said platen and tapered surfaces adjacent to said circular portion;

means for supporting and guiding said secondary jaws for movement adjacent the outer surface of said platen; and means for shifting said secondary jaw toward and away from the opening in said platen;

means for pivoting said pivotal jaw parallel to said platen to shift said jaw from a position angularly spaced from the opening in said platen to a position in alignment therewith; and means for shifting said pivotal jaw in a direction normal to said platen, said pivotal jaw having a circular portion for receiving the neck of a fitment and tapered portions adjacent said circular portion adapted to mate with the tapered portions on said secondary jaw, whereby when said pivotal jaw is disposed adjacent said opening and said secondary jaw is reciprocated into contact therewith, said pivotal jaw, due to engagement of said tapered surfaces of said jaws, is forced against the flange of said fitment and in turn forces said flange into sealing contact with said platen.

11. The apparatus of claim 5 in which said means for transferring a lid into contact with said rim comprises:

a vacuum head for lifting a lid placed on said fitment, removing said lid to a position spaced from said fitment and returning said lid into position in contact with said fitment;

means moving said vacuum head to a position intermediate said fill tube and said opening and to a position offset from said fill tube and opening.

12. The apparatus of claim 6 in which said means for sealing said housing from said filling chamber comprises a disc member and power means for pivoting and raising and lowering said disc member to shift it to a first position covering said top wall opening and a second position remote from said top wall opening.

13. The apparatus of claim 11 in which said heat sealing means is mounted for movement with said vacuum means.

14. The apparatus of claim 5 in which said means for transporting a lid into contact with said rim comprises:

an arm mounted within said filling chamber;

means for reciprocating said arm and rotating said arm about an axis offset from said opening and fill tube;

a support tube carried by said arm;

a vacuum tube disposed within said support tube and having an enlarged head adapted to engage said lid;

means interconnecting said vacuum tube with a vacuum line;

a heat sealing platen carried by said support tube and movable relative thereto, said heat sealing platen carrying electric heating means and including a skirt adapted to engage the periphery of said lid and force said lid against said rim.

15. The apparatus of claim 14 in which said support tube includes an outwardly extending flange and said heat sealing platen includes an inwardly extending flange surrounding said support tube and adapted to engage the flange thereon, said support tube carrying a lock nut, first spring means interposed between said lock nut and the flange on said heat sealing platen.

16. The apparatus of claim 15 further comprising second spring means surrounding said vacuum tube intermediate the enlarged head on said vacuum tube and the flange on said support tube.

17. The apparatus of claim 8 in which said fill tube housing comprises:

a guide cylinder extending upwardly from said upper wall;

a second cylinder slidable along said guide cylinder in sealed relationship thereto, said second cylinder having a cross-plate secured at its upper end;

hydraulic cylinder means mounted upon said upper wall of said filling chamber and connected to said cross-plate for raising and lowering said cross-plate;

said fill tube being mounted upon said cross-plate and extending downwardly within said guide cylinder and said second cylinder;

means for reciprocating said valve member including an actuating rod interconnected to said valve member and extending upwardly through said fill tube;

a hydraulic cylinder mounted above said fill tube, said cylinder having a piston and piston rod associated therewith, said piston rod being connected to said actuating rod.

18. A system for aseptically filling a flexible container, said system comprising the combination of a flexible container, said flexible container having walls, one of said walls having a fitment secured thereto, said fitment comprising a rigid neck, a flange on the outer periphery of said neck, an exposed sealing rim for receiving a lid in heat sealed relationship therewith, a frangible diaphragm extending across said neck to seal the interior of said container, said frangible diaphragm being spaced inwardly from said sealing rim, apparatus for filling said flexible container comprising:

a filling chamber having a platen, said platen having an opening therethrough;

clamp jaw means disposed exteriorly of said filling chamber engageable with the flange of a fitment for locking said fitment against said platen surrounding the opening in said platen with the neck of said fitment being disposed in registry with and sealing said opening;

fill tube means extending into said chamber and disposed in alignment with said opening and movable toward and away from said opening, said fill tube means carrying a member for rupturing said frangible diaphragm;

said fill tube means comprising a fill tube disposed above said opening in said platen, the axis of said fill tube being perpendicular to said platen;

an asceptic housing for enclosing said fill tube in sealed communication with said filling chamber;

means for retracting said fill tube within said housing; and means for sealing said housing from said filling chamber;

said fill tube means having a portion for sealingly engaging the interior of said neck in an area spaced inwardly from said rim to prevent product discharged from said fill tube from contacting said rim;

means disposed within said filling chamber holding a lid during the filling operation and for transporting a lid into contact with said rim;

means within said chamber for heat sealing said lid to said rim; and means for introducing sterilant into said filling chamber prior to rupture of said frangible diaphragm by said fill tube means to sterilize said chamber, said lid and the exposed portion of said fitment while the interior of said flexible container remains free from sterilant.

19. The system of claim 18 in which said fill tube means comprises:

means for opening and closing the end of said fill tube;

said means for transporting said lid including an arm pivoted about an axis offset from the axis of said fill tube, a vacuum head carried by said arm and means shifting said vacuum head along the axis of said fill tube.

20. The system of claim 19 in which said platen constitutes the bottom wall of said filling chamber and said chamber includes a top wall having an opening formed in alignment with the opening in said platen, said fill tube housing being mounted upon said top wall above said opening.

21. The system of claim 19 in which said means for rupturing said flexible diaphragm comprises a valve member disposed at one end of said fill tube, said valve member being tapered at its upper end to seat against said fill tube and being tapered at its lower end to facilitate fracturing said frangible membrane; and means for reciprocating said valve member from a closed position in contact with said fill tube to an open position extended and spaced therefrom.

22. The system of claim 18 further comprising a lift table for supporting a container beneath said filling chamber and shifting said container toward and away from said filling chamber.

23. The system of claim 18 in which:

said clamping jaw means comprise a pivotal jaw and a secondary jaw;

said secondary jaw having a circular portion for surrounding the neck of a fitment, a flange for engaging the aforesaid flange of said fitment and holding said flange against said platen and tapered surfaces adjacent to said circular portion;

means for supporting and guiding said secondary jaw for movement adjacent the outer surface of said platen; and means for shifting said secondary jaw toward and away from the opening in said platen;

means for shifting said pivotal jaw parallel to said platen to shift said jaw from a position angularly spaced from the opening in said platen to a position in alignment therewith; and means for shifting said pivotal jaw in a direction normal to said platen, said pivotal jaw having a circular portion for receiving the neck of a fitment and tapered portions adjacent said circular portion adapted to mate with the tapered portions on said secondary jaw, whereby when said primary jaw is disposed adjacent said opening and said secondary jaw is reciprocated into contact therewith, said pivotal jaw, due to engagement of said tapered surfaces of said jaws, is forced against the flange of said fitment and in turn forces said flange into sealing contact with said platen.

24. The system of claim 18 in which said means for transferring a lid into contact with said rim comprises:

vacuum means for lifting a lid placed on said fitment, removing said lid to a position spaced from said fitment and returning said lid into position in contact with said fitment.

25. The system of claim 19 in which said means for sealing said housing from said filling chamber comprises a disc member and power means for pivoting and raising and lowering said disc member to shift it to a first position covering said top wall opening and a second position remote from said top wall opening.

26. The system of claim 24 in which said heat sealing means is mounted for movement with said vacuum means.

27. The system of claim 23 in which said pivotal jaw is mounted for pivotal movement and said means for shifting said pivotal jaw effects pivotal movement thereof.

28. The apparatus of claim 6 including means for aseptically rinsing product residue from the fill tube while the fill tube is enclosed within said housing.

29. The appartus of claim 7 further comprising a pressure sensitive switch for sensing whether said vacuum means has captured a lid, said switch preventing movement of said vacuum means unless a lid has been captured.

30. The method of claim 17 further comprising the steps of rinsing said fill tube with condensed steam while said fill tube is sealed within said housing.

31. The apparatus of claim 1 further comprising an insulating sub-platen disposed beneath said platen.

32. The apparatus of claim 31 further comprising an insulating box surrounding said filling chamber whereby said insulating sub-platen and insulating box reduce heat transfer to said container.

33. The system of claim 18 further comprising a flexible heat shield carried by said container surrounding said fitment.

34. The system of claim 33 in which said heat shield comprises a thin laminate of aluminum foil and a plastic.

35. The system of claim 34 in which said heat shield is of annular configuration and includes an opening receiving said neck, said shield being stretchable over said flange and being retained thereby.

36. The system of claim 18 in which said container further comprises a bevelled shoulder surrounding said diaphragm, said fill tube means including an annular shoulder for sealingly engaging said bevelled shoulder when said diaphragm is ruptured.

* * * * *

UNITED STATES PATENT AND TRADEMARK OFFICE

CERTIFICATE OF CORRECTION

PATENT NO. : 4,494,363

DATED : January 22, 1985

INVENTOR(S) : Albert F. Rica, John C. Davis and Ronald J. Reiss

It is certified that error appears in the above-identified patent and that said Letters Patent is hereby corrected as shown below:

Column 9, line 64 "100" should be --110--

Column 10, line 38 "131" should be --132--

Column 11, line 17 "33" should be --133--

Column 12, line 4 "heat" should be --head--

Column 13, line 20 "162" should be --62--

Column 16, line 55 "comprises" should be --comprising--

Column 19, line 36 after "chamber" insert --for--

UNITED STATES PATENT AND TRADEMARK OFFICE

CERTIFICATE OF CORRECTION

PATENT NO. : 4,494,363

DATED : January 22, 1985

INVENTOR(S) : Albert F. Rica, John C. Davis and Ronald J. Reiss

It is certified that error appears in the above-identified patent and that said Letters Patent is hereby corrected as shown below:

Column 20, line 59 "appartus" should be --apparatus--

Column 20, line 59 "7" should be --11--

Column 20, line 67 "1" should be --5--

Signed and Sealed this

*Thirtieth* Day of *July 1985*

[SEAL]

*Attest:*

DONALD J. QUIGG

*Attesting Officer* *Acting Commissioner of Patents and Trademarks*